United States Patent [19]

Anderson et al.

[11] Patent Number: 4,999,792

[45] Date of Patent: Mar. 12, 1991

[54] METHOD AND APPARATUS FOR AUTOMATIC FUEL CHANGEOVER

[75] Inventors: Gregory W. Anderson, Savage; William R. Landis, Bloomington; Paul B. Patton, Rockford, all of Minn.; Paul A. Schimbke, Shorewood; Michael J. Seidel, Wauwatosa, both of Wis.

[73] Assignee: Honeywell Inc., Minneapolis, Minn.

[21] Appl. No.: 303,421

[22] Filed: Jan. 27, 1989

[51] Int. Cl.[5] ..... F23N 5/00

[52] U.S. Cl. ..... 364/550; 431/2

[58] Field of Search ..... 364/550, 551.01, 505, 364/506, 557; 236/1 A, 15 E, 14, 46 C, DIG. 4, DIG. 8; 237/16; 431/29, 31, 36, 42, 18, 2, 6, 12, 18, 30, 62, 63, 278; 432/2, 17, 19, 41, 51

[56] References Cited

U.S. PATENT DOCUMENTS

| | | | |
|---|---|---|---|
| 3,814,569 | 6/1974 | Jacobsz | 432/41 X |
| 4,035,135 | 7/1977 | Jacobsz | 431/29 |
| 4,140,067 | 2/1979 | Jensen | 431/6 |
| 4,140,472 | 2/1979 | Hoehing | 431/12 X |
| 4,140,473 | 2/1979 | Hoehing et al. | 431/36 X |
| 4,309,168 | 1/1982 | Prill et al. | 431/12 X |
| 4,395,224 | 7/1983 | Cade | 431/31 |
| 4,482,312 | 11/1984 | Cade | 431/31 |
| 4,614,438 | 9/1986 | Kobayashi | 431/12 X |
| 4,699,586 | 10/1987 | Snyder | 431/2 X |
| 4,739,714 | 4/1988 | LaSpisa et al. | 431/12 X |
| 4,747,771 | 5/1988 | Goodfellow et al. | 431/2 X |
| 4,834,644 | 5/1989 | Snow | 431/12 X |
| 4,842,510 | 6/1989 | Grunden et al. | 431/31 X |
| 4,891,004 | 1/1990 | Ballard et al. | 431/6 |

*Primary Examiner*—Joseph L. Dixon

*Attorney, Agent, or Firm*—Kinney & Lange

[57] ABSTRACT

The present invention is a method and apparatus for changing fuels used in a heating system without substantially recycling the heating system where a main flame burns fuel supplied to the heating system. A fuel changeover signal is received from a fuel selector. Flow of a first fuel to the heating system is regulated in response to the fuel changeover signal to achieve a low fire state in the heating system. A pilot flame is established in the heating system and flow of the first fuel is shut off. A fuel indicator signal is received from the fuel selector indicating a desired fuel. The main flame in the heating system which is burning the first fuel is extinguished. The pilot flame is monitored for stability and the main flame is re-established in the heating system burning the desired fuel in response to the fuel indicator signal.

28 Claims, 6 Drawing Sheets

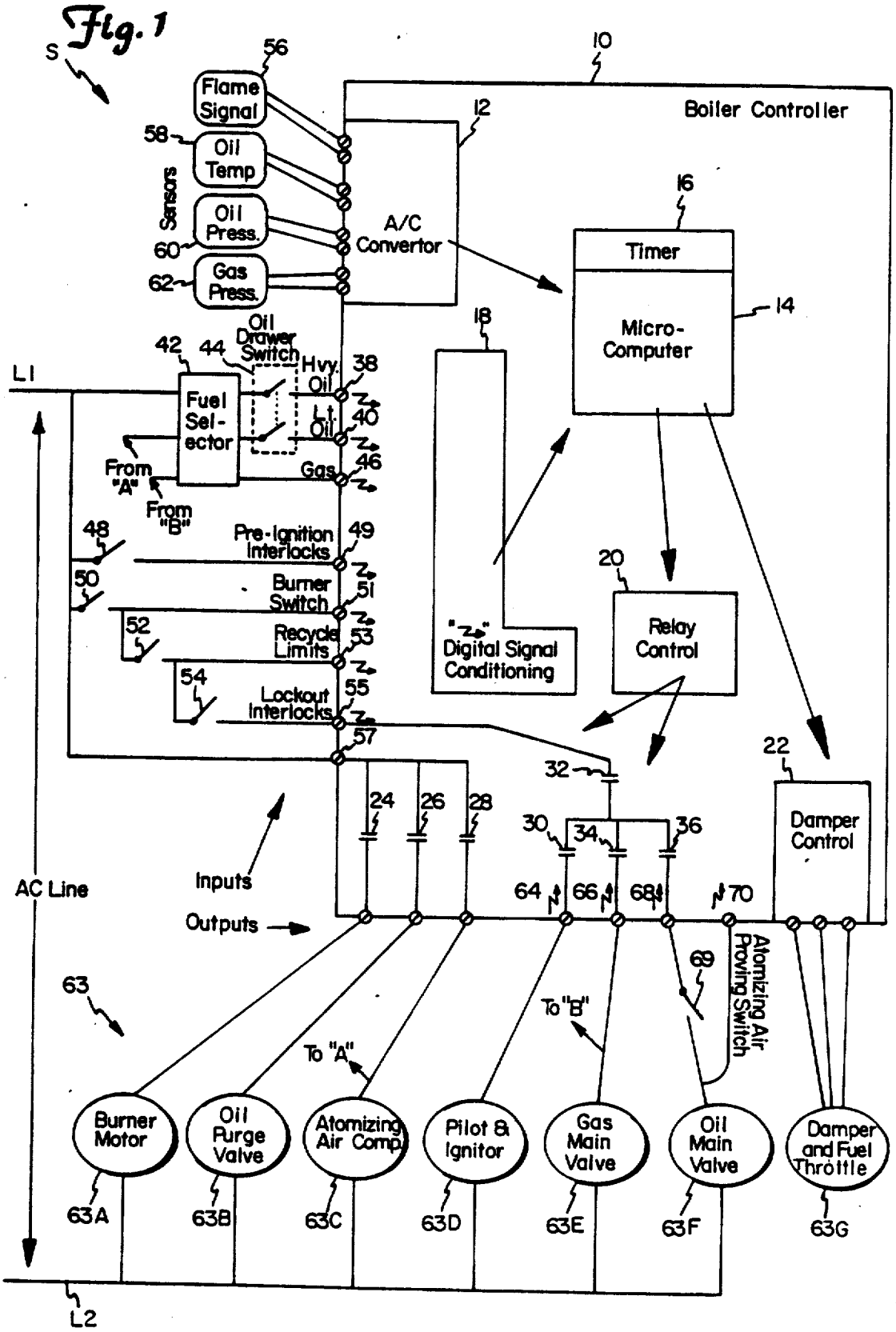
Fig. 1
S
10
Boiler Controller
12
A/C Convertor
16
Timer
14
Micro-Computer
18
"Z" Digital Signal Conditioning
20
Relay Control
22
Damper Control
Sensors
56
Flame Signal
58
Oil Temp
60
Oil Press.
62
Gas Press.
L1
42
Fuel Sel-ector
44
Oil Drawer Switch
Hvy. Oil
38
Lt. Oil
40
Gas
46
From "A"
From "B"
48
50
52
54
Pre-Ignition Interlocks
49
Burner Switch
51
Recycle Limits
53
Lockout Interlocks
55
57
24
26
28
30
32
34
36
64
66
68
70
69
Atomizing Air Proving Switch
Inputs
Outputs
AC Line
63
To "A"
To "B"
Burner Motor
Oil Purge Valve
Atomizing Air Comp.
Pilot & Ignitor
Gas Main Valve
Oil Main Valve
Damper and Fuel Throttle
63A
63B
63C
63D
63E
63F
63G
L2

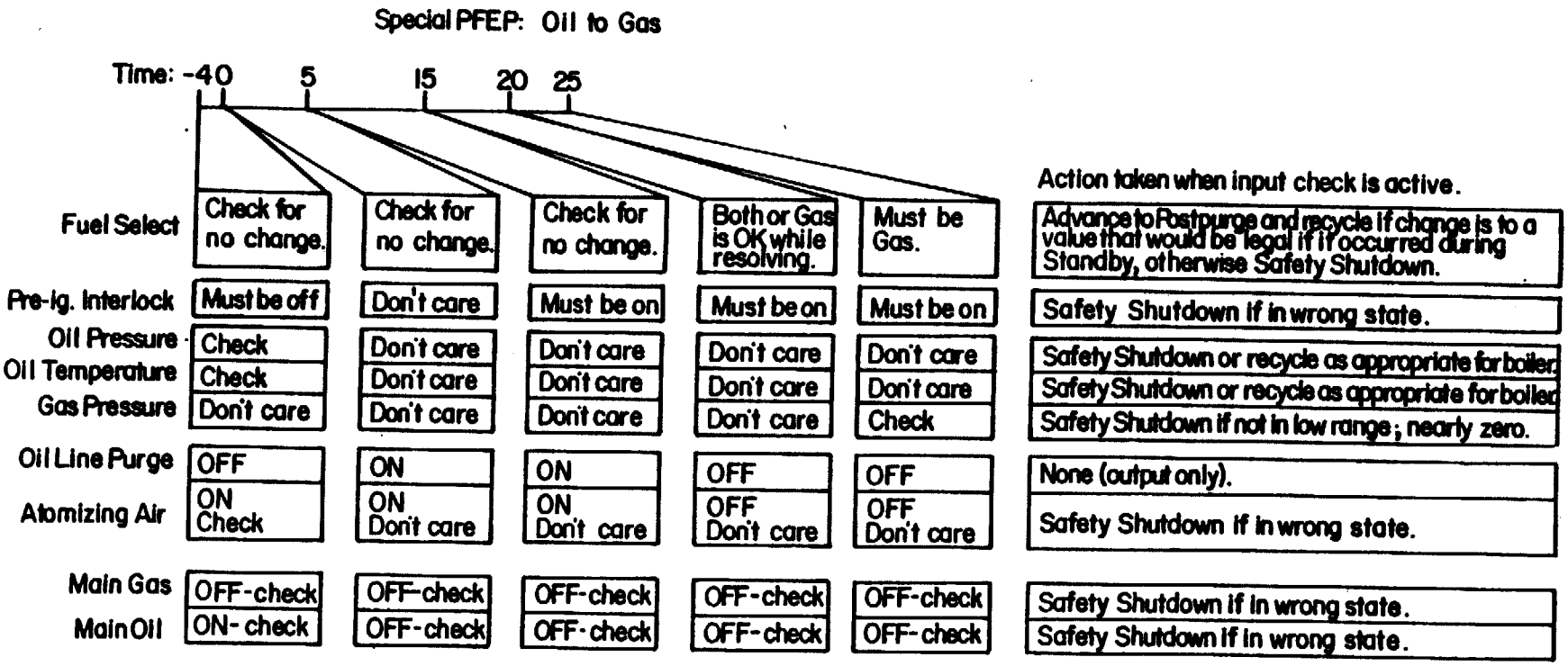
Special PFEP: Oil to Gas
Time: -40
5
15
20
25
Fuel Select
Pre-Ig. Interlock
Oil Pressure
Oil Temperature
Gas Pressure
Oil Line Purge
Atomizing Air
Main Gas
Main Oil
Check for no change.
Check for no change.
Check for no change.
Both or Gas is OK while resolving.
Must be Gas.
Must be off
Check
Check
Don't care
Don't care
Don't care
Don't care
Don't care
Don't care
Don't care
Don't care
Don't care
Don't care
Don't care
Check
Check
Don't care
Don't care
Don't care
Don't care
Don't care
Don't care
Don't care
Don't care
Don't care
Don't care
Don't care

METHOD AND APPARATUS FOR AUTOMATIC FUEL CHANGEOVER

BACKGROUND OF THE INVENTION

1. Field of the Invention

The present invention relates to a method and apparatus for changing fuels used in a heating system. More particularly, the present invention is a method and apparatus for changing fuels burned in a heating system without substantially recycling the heating system.

2. Description of the Prior Art

There are many uses for industrial heating systems such as ovens, furnaces and boilers. Many of these heating systems are equipped to burn two fuels, typically natural gas and fuel oil. For example, a school might receive a lower purchase rate for natural gas by agreeing with a natural gas company to switch to oil when the gas company is unable to meet the demands of all its customers. In that case, the school would be notified and would have a certain amount of time to change fuels.

Another example is a boiler used to provide steam for a factory process. When a fuel changeover is required, it may be vital that the fuel changeover is a quick, efficient changeover from one fuel to the other to prevent the loss of steam pressure. The factory demand for steam may continue while the fuel changeover is in progress.

A typical cycle performed by a boiler controller which controls the boiler can be divided into the following major divisions or "states":

Pre-purge, during which the combustion chamber in the boiler is ventilated to remove any fumes from unburned fuel.

Pilot flame establishing period (PFEP) during which a pilot flame is ignited and is monitored to ensure that it is burning.

Main flame establishing period (MFEP) during which the main flame is ignited and is monitored to ensure that it is burning.

Run, during which the boiler runs providing heat as either steam or hot water.

Post-purge, during which the combustion chamber is ventilated for a time interval that allows the main flame to extinguish.

Standby, during which the controller is idle and the burner is off.

In the past, in order to change from one fuel to another in a heating system, the most direct way was by performing a manual operation that included a complete recycling of the burner. A boiler operator would turn off the "burner switch" to cause the burner to shutdown. The shutdown sequence of events typically included the post-purge period after which the burner entered the standby state. While the burner was in the standby state, preparation for burning the alternate fuel would be performed. This involved such tasks as opening some fuel valves and closing others and possibly making some modifications to the burner. Also, since the boiler controller provides safety by testing, among other things, a set of sensors and switch contacts which monitor the fuel system for correct operation, the sensors and contacts for the old fuel would be disabled and those for the new fuel would be enabled.

Following these preparations, the burner switch would then be closed by the boiler operator to restart the boiler via its normal start-up sequence. The start-up sequence typically included a pre-purge period, a PFEP, and a MFEP. Finally, the burner would be running using the new fuel.

This changeover method takes substantial time and manual intervention and wastes heat energy during the post-purge and pre-purge periods. The amount of heat energy lost due to unneeded purging can be a considerable expense over a year's time, and the lost time due to making the adjustments can make the difference between a factory process continuing to run and being temporarily suspended.

Another method for changing fuels which has been used is a custom-made fuel changeover device which is used to automate the fuel changeover process or certain parts of it. However, operation of these devices has not been integrated into the boiler controller. In order to accomplish the changeover, the custom-made fuel changeover devices effectively "trick" the boiler controller into performing certain tasks. Therefore, there is less assurance that the changeover process is being implemented in a correct and safe manner.

For these reasons, there is a need for a changeover process which improves on the manual fuel changeover process by substantially eliminating the need for operator intervention and by minimizing the wasted heat energy and time attributable to the post-purge and pre-purge periods. Also, there is a need for an automatic fuel changeover process which is integrated into the boiler controller's normal operation so potential safety and effectiveness problems which can result by using typical custom-made devices are removed.

SUMMARY OF THE INVENTION

The present invention is a method and apparatus for changing fuels used in a heating system without substantially recycling the heating system. A main flame burns fuel supplied to the heating system. A fuel changeover signal is received from a fuel selector and the flow of a first fuel to the heating system is regulated, in response to the fuel changeover signal, to achieve a low fire state in the heating system. A pilot flame is established in the heating system and the flow of the first fuel is shutoff. A fuel indicator signal is received from the fuel selector, within a predetermined time period, indicating a desired fuel. The main flame in the heating system is extinguished and the pilot flame is monitored for stability. Finally, the main flame in the heating system is re-established burning the desired fuel in response to the fuel indicator signal.

BRIEF DESCRIPTION OF THE DRAWINGS

FIG. 1 is a block diagram of a portion of a heating system.

FIG. 4A is a diagram showing the state of various boiler controller inputs and outputs in relation to time.

DETAILED DESCRIPTION OF THE PREFERRED EMBODIMENTS

Figure 2A:
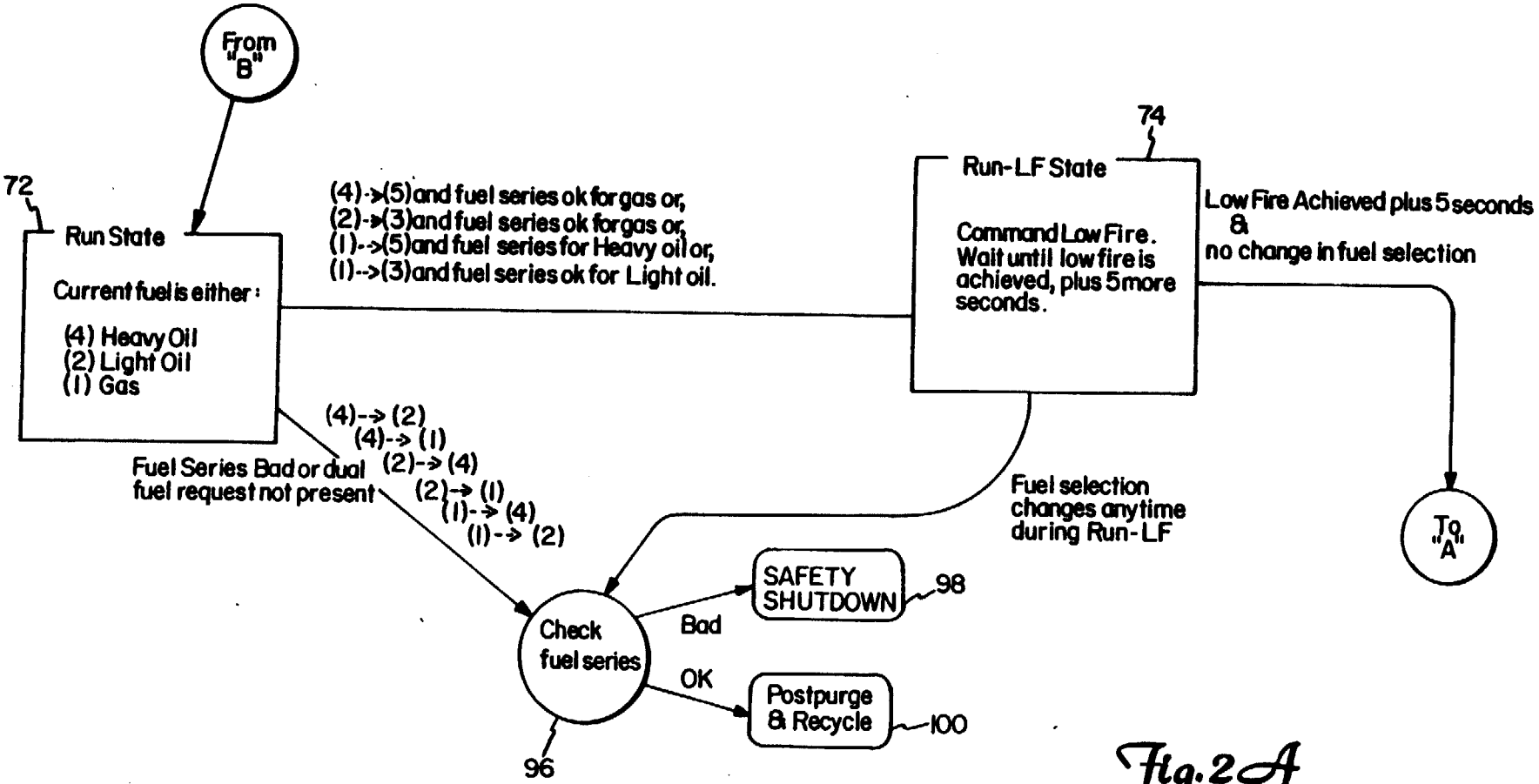
FIG. 2A is a flow diagram of a portion of the fuel changeover process of the present invention.

The fuel changeover process of the present invention is suited for use with any heating system which is set up to use more than one fuel. However, for simplicity's sake, the present invention will be described with reference to a boiler set up to use fuel oil and gas.

FIG. 1 is a block diagram of a portion of heating system S. Boiler controller 10 is coupled to various inputs and outputs which are associated with the fuel changeover process of the present invention. Boiler controller 10 includes analog-to-digital(A/D) convertor 12, micro-computer 14, timer 16 (which is used as a timing mechanism for micro-computer 14), digital signal conditioning 18, relay control 20, damper control 22, burner motor relay contacts 24, oil purge valve contacts 26, atomizing air compressor contacts 28, pilot and ignitor contacts 30, safety contacts 32, gas main valve contacts 34, and oil main valve contacts 36. Boiler controller 10 has heavy oil input 38 and light oil input 40 which are coupled to fuel selector 42 by oil drawer switch 44. Also boiler controller 10 is coupled to fuel selector 42 at gas input 46. AC line voltage is supplied to boiler controller 10 through fuel selector 42, pre-ignition interlocks 48 at pre-ignition interlocks input 49, burner switch 50 at burner switch input 51, recycle limits switch 52 at recycle limits input 53, lockout interlocks 54 at lockout interlocks input 55 and at AC input 57.

Boiler controller 10 uses solid state analog sensors 56, 58, 60 and 62 to monitor an oil fuel system and a gas fuel system. Sensors 56, 58, 60 and 62 are always coupled to boiler controller 10 using dedicated inputs. This enables boiler controller 10 to monitor the set of inputs that is appropriate to the fuel being used. The analog signals provided by analog sensors 56, 58, 60, and 62 are converted to digital signals in A/D converter 12 and provided to micro-computer 14.

In this preferred embodiment, flame signal sensor 56 provides an analog signal to boiler controller 10 indicating the presence or absence of a flame. Oil temperature sensor 58 provides an analog signal indicating the fuel temperature when oil is used as the fuel. Oil pressure sensor 60 provides an analog signal to A/D converter 12 indicating the fuel pressure when oil is used as the fuel and gas pressure sensor 62 provides an analog signal to A/D converter 12 indicating fuel pressure when gas is used as the fuel.

Fuel selector 42 provides signals to boiler controller 10 which request either a single fuel or an automatic fuel changeover. This will be described in more detail later. Fuel selector 42 is controllable by either a simple manually operated switch or, in this preferred embodiment, is capable of responding to remote control via telephone.

Fuel selector 42 receives, as inputs, line voltage L1 atomizing air signal A from an atomizing air compressor 63C and gas main signal B from a gas main valve 63E. The atomizing air compressor assures that atomizing air is present for combustion when oil is the fuel being used. The gas main valve operates to turn on and off the flow of fuel to the boiler when gas is the fuel being used. Based on these inputs, fuel selector 42 provides fuel select signals to heavy oil input 38, light oil input 40, and gas input 46 selecting a fuel or a fuel changeover in correct timing.

Oil drawer switch 44 is a safety feature. An oil burner nozzle (not shown) is inserted into the combustion chamber in heating system S to supply oil to the combustion chamber when oil is the selected fuel. If the oil burner nozzle is withdrawn from the combustion chamber, oil drawer switch 44 opens and immediately and unconditionally de-energizes oil inputs 38 and 40 from fuel selector 42. This causes micro-computer 14 to prevents a potentially dangerous situation in which oil could spray from the oil burner nozzle when it is not in the combustion chamber.

Pre-ignition interlocks 48, burner switch 50, recycle limits 52 and lockout interlocks 54 are shown in a typical configuration. For simplicity's sake, only one switch contact is shown for each. More typically, however, switches 48, 50 and 52 each would be a string of series connected contacts. These switch contacts are typically transducer controlled contacts set up to sense various parameters in heating system S. By sampling inputs 49, 51, 53, and 55 microcomputer 14 acquires needed information to control heating system S.

The outputs from boiler controller 10 are shown connected to typical loads 63 such as a burner motor 63A, an oil purge valve 63B, an atomizing air compressor 63C, a pilot and ignitor 63D, a gas main valve 63E, and an oil main valve 63F, all of which are energized and de-energized by boiler controller 10 in controlling heating system S. Damper control 22 controls a damper and fuel throttle 63G based on commands from micro-computer 14.

Atomizing air proving switch 69 is a transducer controlled switch similar to switches 48, 52 and 54. It opens when insufficient atomizing air is sensed in the combustion chamber for proper combustion thereby de-energizing the oil main valve 63F. The state of atomizing air proving switch 69 is monitored by boiler controller 10 by sampling AAPS input 70.

The signals appearing at heavy oil input 38, light oil input 40, gas input 46 (collectively referred to as fuel select inputs 38, 40 and 46), pre-ignition interlocks input 49, burner switch input 51, recycle limits input 53, lockout interlocks input 55, pilot and ignitor output 64, gas main valve output 66, oil main valve output 68 and AAPS input 70 are fed back to digital signal conditioning 18 where they are conditioned and provided to micro-computer 14.

Based on the inputs from digital signal conditioning 18, as well as those from A/D convertor 12, micro-computer 14 commands outputs to relay control 20. Relay control 20 controls the state of relay contacts 24, 26, 28, 30, 32, 34 and 36. Additionally, micro-computer 14 commands outputs to damper control 22 which, in turn, controls the damper and fuel throttle 63G.

Boiler controller 10 reads the signals provided at fuel select inputs 38, 40 and 46 (after being conditioned) as a three bit binary code. For convenience in referring to these codes, they are represented here as decimal number codes as shown in Table 1. Table 1 relates these codes to the state of fuel select inputs 38, 40 and 46 corresponding to each code.

TABLE I

| Code | Heavy Oil Select | Light Oil Select | Gas Select |
|---|---|---|---|
| [0] | off | off | off |
| [1] | off | off | on |
| [2] | off | on | off |
| [3] | off | on | on |
| [4] | on | off | off |

TABLE 1-continued

| Code | Heavy Oil Select | Light Oil Select | Gas Select |
|---|---|---|---|
| [5] | on | off | on |
| [6] | on | on | off |
| [7] | on | on | on |

[0]- no fuel is selected or the oil drawer switch is open.
[1]- gas is selected.
[2]- light oil is selected.
[3]- an automatic changeover is requested from gas to light oil or vice versa.
[4]- heavy oil is selected.
[5]- an automatic changeover is requested from gas to heavy oil or vice versa.
[6]- illegal output of the fuel selector (automatic changeover between two weights of oil is usually not allowed because it typically requires changing an oil burner nozzle).
[7]-illegal output of the fuel selector.

Figure 2B:
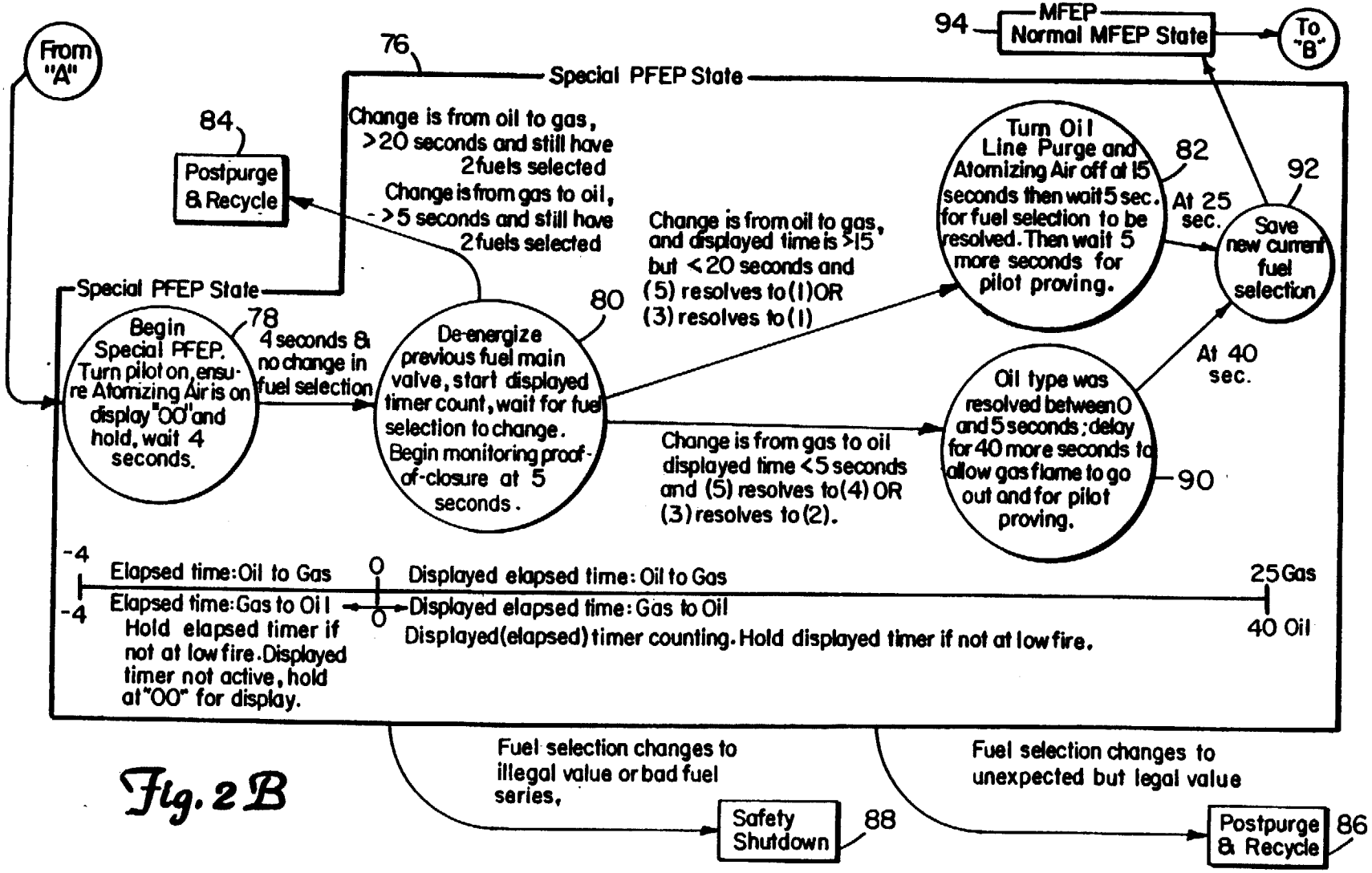
FIG. 2B is a flow diagram of a portion of the fuel changeover process of the present invention.

FIG. 2A is to be read in conjunction with FIG. 2B. These figures show a state diagram of the fuel changeover process of the present invention. States are generally shown as shaded rectangular boxes with transitions between them indicated by arrows. The reasons for making a transition is shown as a label on the arrows. Transitions that abort the fuel changeover process are shown by arrows pointing to small rectangles with rounded corners that indicate either a normal post-purge followed by a normal standby state (possibly followed by pre-purge, etc.), or an abort to a safety shutdown state which keeps the boiler off until the boiler operator takes some action. Actions taken during a state or in the transition between states are shown as circles containing descriptive text.

Not all signals and events that could occur are shown in FIGS. 2A and 2B. For instance, during the run state, a large number of conditions could cause a typical boiler controller to initiate the post-purge state. Examples include opening burner switch 50 or recycle limits 52. The events described in FIGS. 2A and 2B are primarily only those that are related to fuel changeover.

A transition between two fuel selector outputs shown in Table 1 is indicated in FIGS. 2A and 2B by connecting them with an arrow. For example, [1]→[3] represents a change from a request for gas to a request for an automatic changeover to light oil, and [5]→[1] indicates that outputs from fuel selector 42 are changing from a request for a changeover between heavy oil and gas to a request for gas only.

Boiler controller 10 both responds to transitions and, at times, expects them to occur. In particular, a change from a request for a single fuel to a request for that fuel plus some new fuel is interpreted as an automatic fuel changeover request. After that requested action has begun, the request must resolve into a single fuel request for the new fuel within a certain time. A request for a single fuel which changes to a request for some other single fuel is interpreted by boiler controller 10 as a request for a more ordinary fuel changeover that includes a post-purge for the old fuel followed by a normal start-up including a pre-purge, PFEP and MFEP for the new fuel.

FIGS. 2A and 2B make reference to a "fuel series" in relation to allowing a particular fuel. The fuel series is a code that is part of the programming of boiler controller 10. Through this code, boiler controller 10 is provided with the type of boiler it is controlling and specifically, which fuels are to be allowed for the particular boiler. The fuel series code is typically provided either as a built-in part of memory in boiler controller 10, via switches that are internal components of controller 10, or through an interactive configuration procedure using the control panel of controller 10 (not shown).

Block 72 indicates that the boiler in heating system S is in the run state and that a current fuel is either heavy oil, light oil or gas. During the run state, boiler controller 10 receives a transition at fuel select outputs 38, 40 and 46 from fuel selector 42. The transitions may be one of the following:

[4]→[5] and the fuel series allows gas; or
[2]→[3] and the fuel series allows gas; or
[1]→[5] and the fuel series allows heavy oil; or
[1]→[3] and the fuel series allows light oil.

If one of these transitions occurs, boiler controller 10 stops commanding a run state and commands a run-low-fire (run-LF) state. The run-LF state is similar to the run state except that, during the run-LF state, damper control 22 is commanded to move the damper to a low fire position to prepare to shutoff the main fuel valve. Once the damper has achieved this position and remains stable for a period of time, in this preferred embodiment 5 seconds, boiler controller 10 enters a special PFEP state. This is indicated by blocks 74 and 76.

FIG. 2B shows a time line which corresponds to the actions taken in the special PFEP state. First, the atomizing air compressor is turned on (if oil was the selected fuel, the atomizing air compressor is already on) and the pilot/ignitor is turned on to ignite a pilot flame. Then a four second hold occurs to allow the pilot flame to become stable. This is indicated by circle 78. During this time, the main flame in the combustion chamber is still burning the "old" fuel.

Following the four second hold, at time zero, the fuel main for the "old" fuel is turned off. Five seconds after the main fuel valve is turned off, the pre-ignition interlock is monitored. The pre-ignition interlock provides boiler controller 10 with a signal indicating whether the main fuel valve is closed. The 5 second delay before beginning to monitor the pre-ignition interlock is used to give the main fuel valve enough time to close. This is indicated by circle 80.

Fuel selector 42 is expected to resolve its two-fuel selection into a selection of a single fuel within a period of time. The time allowed in the exact sequence of events taken by boiler controller 10 depends on the fuel selected and the change type selected by fuel selector 42 (e.g. gas-to-oil or oil-to-gas). Each fuel extinguishes differently and each requires different start-up conditions.

For an oil-to-gas changeover, the oil purge valve is turned on at time zero and it remains on, along with the atomizing air compressor, until 15 seconds later when both are turned off. This 15 second time interval allows the oil burner to be purged. The selected fuel from fuel selector 42 must then resolve from a two-fuel request (the original changeover request) to a request for gas only within 5 seconds. Fuel selector 42 uses the time at which the atomizing air compressor is turned off as its signal to resolve the two-fuel selection into a single fuel. If fuel selector 42 properly resolves to a single fuel request (for gas), boiler controller 10 monitors the pilot flame to assure that it is stable. This is indicated in circle 82. Finally, boiler controller 10 saves the new fuel selection selected by fuel selector 42 and enters the MFEP state establishing the main flame in the combustion chamber using the new fuel. This is indicated in circle 92 and block 94. Once the main flame is established, the boiler enters the run state as shown in block 72.

If any of the steps previously described do not happen in the described order, then the special PFEP state is aborted. Either the post-purge state is entered to cause the fuel changeover to occur in a more typical way by recycling the boiler, as shown in blocks 84 and 86; or a safety shutdown occurs which indicates a malfunction to the boiler operator as indicated in block 88.

For a gas-to-oil changeover, the atomizing air compressor is turned on at the beginning of the special PFEP state to allow for a light-oil pump, which pumps oil to the combustion chamber and which may be connected to be controlled by the atomizing air output of boiler controller 10, to get up to speed. Fuel selector 42 must resolve to a single fuel selection indicating the type of oil allowed by the fuel series code within 5 seconds after the main gas valve is turned off. If it does not, then either a post-purge and recycle or a safety shutdown is issued as described above.

However, if fuel selector 42 properly resolves to a single fuel request (for oil), then a 30 second delay occurs to allow the "old" gas flame to extinguish (a gas flame may linger for nearly 30 seconds). Next, boiler controller 10 monitors the pilot flame for 10 seconds to assure that it is stable. This is indicated in circle 90. Finally, as in an oil-to-gas changeover boiler controller 10 saves the new fuel selection selected by fuel selector 42 and enters the MFEP state establishing a main flame in the combustion chamber using the new fuel. This is indicated in circle 92 and block 94. Once the main flame is established, the boiler enters the run state as shown in block 72.

If boiler controller 10 receives a fuel selection not allowed by the fuel series (a "bad fuel series") during the run state or receives a signal from fuel selector 42 indicating a selection where a dual fuel request is not present, boiler controller 10 checks the fuel series. If it is bad, that is, if it does not allow the selected fuel, boiler controller 10 issues a safety shutdown. If it is valid, boiler controller 10 interprets this signal as a request for an ordinary fuel changeover and begins to recycle by entering a post-purge state. This is indicated in blocks 96, 98 and 100.

Figure 3:
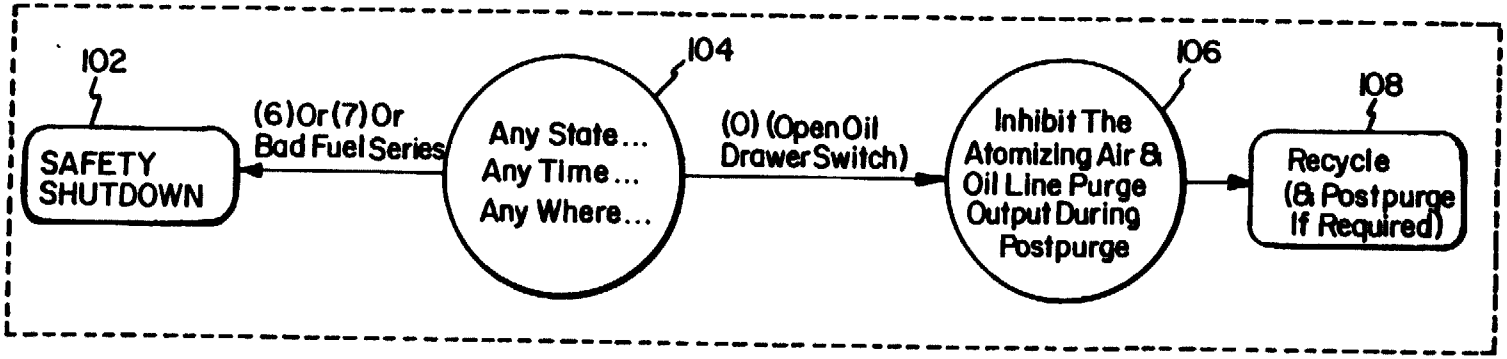
FIG. 3 is a state diagram of a portion of the fuel changeover process of the present invention.

FIG. 3 shows a state diagram of functions that are always active regardless of the state of the fuel changeover process of the present invention. No matter what state boiler controller 10 is in, if it receives an illegal fuel selection or a fuel selection that is not allowed by the fuel series ("a bad fuel series") from fuel selector 42, it issues a safety shutdown. Also, no matter what state boiler controller 10 is in, if it receives the open oil drawer switch signal (code [0]), it inhibits the atomizing air and the oil purge valve outputs during post-purge, then recycles the boiler. This is shown in circles 102, 104, 106 and 108.

Figure 4B:
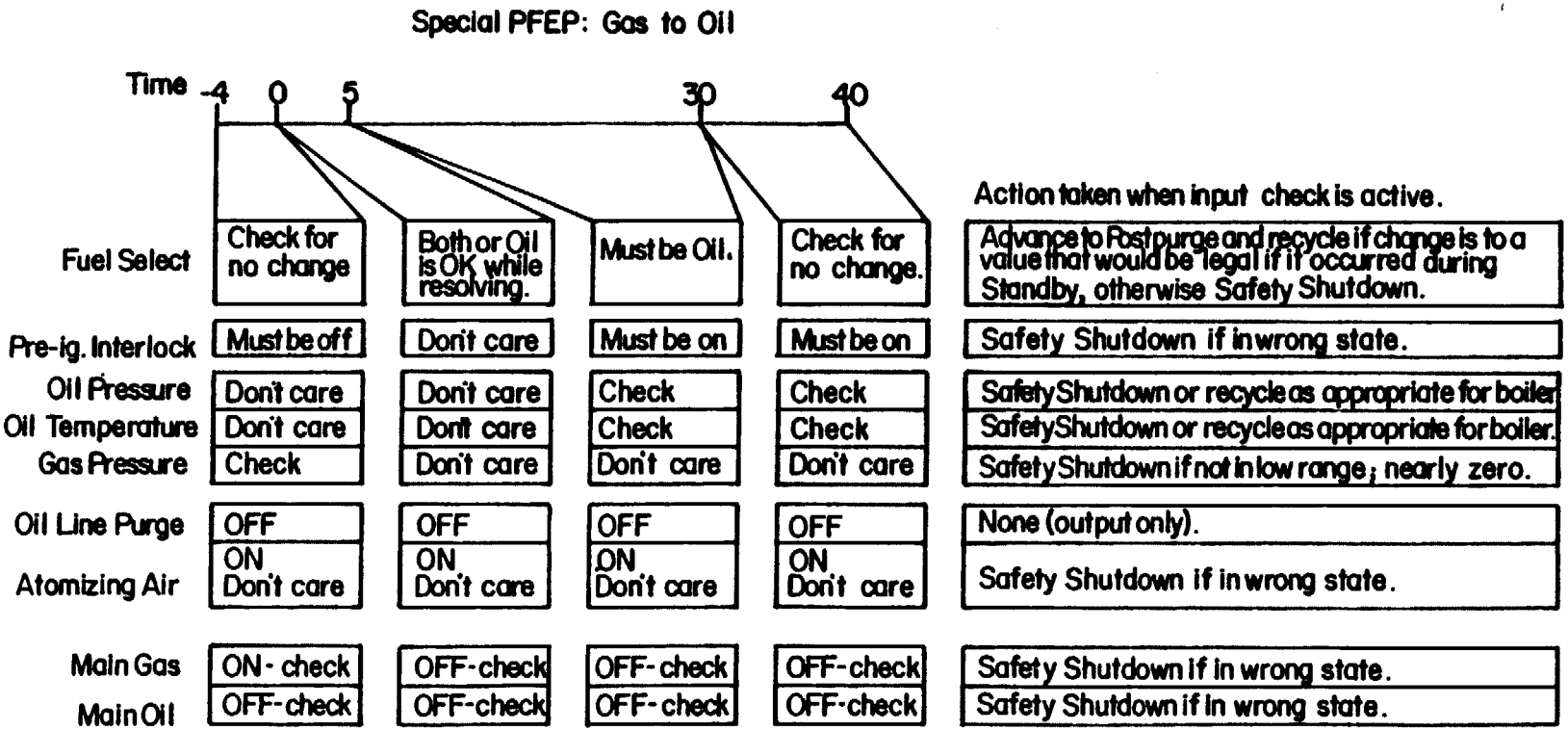
FIG. 4B is a diagram showing the state of various boiler controller inputs and outputs in relation to time.

FIGS. 4A and 4B show a list of the inputs which are tested by boiler controller 10 and the commanded state of the outputs during the special PFEP state shown by block 76 in FIG. 2B. Several signals, such as the flame signal, and signals from burner switch 50, recycle limits 52, lockout interlocks 54 and the pilot/ignitor are not shown in FIG. 3 but are monitored and must be in correct states for the special PFEP state to proceed. The function of fuel selector 42 and the main gas and main oil valves has already been described in conjunction with FIGS. 2A and 2B.

Pre-ignition interlock input 49, which is monitored to ensure that the fuel valves are, in fact, turned off is tested during the special PFEP state for both open and closed states. Therefore, this safety-critical input is not able to be bypassed without detection.

Boiler controller 10 switches between monitoring the oil pressure and oil temperature and monitoring gas pressure during the special PFEP state to automatically stop monitoring the status of the old fuel and start monitoring the status of the new fuel at the proper times.

The oil purge valve 63B is energized to purge the oil burner during the changeover from oil to gas. However, if the oil nozzle is removed from the combustion chamber, indicated by the opening of oil drawer switch 44, this purging is inhibited.

Similarly, the atomizing air compressor 63C will be energized while oil is being burned or purged but will be inhibited if oil drawer switch 44 is open.

During the first 4 seconds of the special PFEP state for an oil-to-gas transition, the oil main valve 63F is on and so is the atomizing air compressor 63C. At time zero, when the oil main valve 63F is turned off, contacts 36 are opened and power is turned off through atomizing air proving switch 69. Therefore, the status of AAPS 69 becomes "don't care" because it is not testable During a gas-to-oil transition, the atomizing air compressor 63C is turned on but contacts 36 are open. Therefore, testing of the atomizing air compressor 63C through AAPS 69 must wait until the MFEP state when the oil main valve 63F is again commanded to turn on by boiler controller 10 through closure of contacts 36.

The automatic fuel changeover process of the present invention improves on the manual changeover process by eliminating the need for operator intervention (except that fuel changeover may be initiated by an operator). Similarly, heat energy and time losses attributable to the post-purge and pre-purge periods are minimized.

Also, the automatic fuel changeover process of the present invention is integrated into the normal operation of boiler controller 10. Therefore, potential safety and effectiveness problems of previous custom-made fuel changeover devices is substantially reduced.

Although the present invention has been described with reference to preferred embodiments, workers skilled in the art will recognize that changes may be made in form and detail without departing from the spirit and scope of the invention.

What is claimed:

1. A method for changing fuels used in a heating system without substantially recycling the heating system where a main flame burns fuel supplied to the heating system, the method comprising:

receiving a fuel changeover signal from a fuel selector;

regulating flow of a first fuel to the heating system, in response to the fuel changeover signal, to achieve a low fire state in a heating system;

establishing a pilot flame in the heating system;

shutting off the flow of the first fuel;

automatically receiving a fuel indicator signal from the fuel selector indicating a desired fuel within an indication time period;

extinguishing the main flame in the heating system burning the first fuel without performing a complete purge of the first fuel from the heating system;

monitoring the pilot flame for stability; and automatically re-establishing the main flame in the heating system burning the desired fuel in response to the fuel indicator signal.

2. The method of claim 1 wherein the step of establishing a pilot flame further comprises:
igniting the pilot flame in the heating system; and
delaying for a stabilization period to allow the pilot flame to stabilize.

3. The method of claim 1 wherein the step of shutting off the flow of the first fuel further comprises:
closing a first fuel valve in a first fuel line supplying the heating system with the first fuel to block the flow of the first fuel in the first fuel line; and
monitoring the first fuel valve for a closure time period to ensure that the first fuel valve is closed.

4. The method of claim 1 wherein the first fuel comprises oil.

5. The method of claim 4 wherein the step of extinguishing the main flame further comprises:
purging an oil burner for a purge time period.

6. The method of claim 5 wherein the step of purging further comprises:
energizing an oil purge output to rid the oil burner of any remaining oil.

7. The method of claim 1 wherein the indication time period expires before the step of extinguishing the main flame.

8. The method of claim 7 wherein the first fuel comprises gas.

9. The method of claim 8 wherein the step of extinguishing the main flame comprises:
delaying for an extinguishing time period to allow the main flame to burn any remaining gas.

10. The method of claim 1 and further comprising:
providing atomizing air before shutting off the flow of the first fuel.

11. The method of claim 1 and further comprising:
issuing a safety shutdown of the heating system when the fuel changeover signal represents an invalid fuel selection.

12. The method of claim 1 and further comprising:
issuing a safety shutdown of the heating system when the fuel indicator signal indicates that a plurality of fuels are the desired fuel.

13. The method of claim 1 and further comprising:
post-purging the heating system when the fuel indicator signal is not received from the fuel selector within the indication time period, and
recycling the heating system after post-purging.

14. The method of claim 13 wherein the steps of post-purging and recycling are performed when the fuel indicator signal changes to an unexpected, valid value.

15. An apparatus for changing fuels used in a heating system without substantially recycling the heating system where a main flame burns fuel supplied to the heating system, comprising:
receiving means for receiving a fuel changeover signal from a fuel selector;
regulating means for regulating flow of a first fuel to the heating sysstem, in response to the fuel changeover signal, to achieve a low fire state in the heating system;
pilot establishing means for establishing a pilot flame in the heating system;
inhibiting means for inhibiting the flow of the first fuel;
fuel indicator receiving means for receiving a fuel indicator signal from the fuel selector indicating a desired fuel within an indication time period;
extinguishing means for extinguishing the main flame in the heating system burning the first fuel;
monitoring means for monitoring the pilot flame for stability; and
main flame establishing means for re-establishing the main flame in the heating system burning the desired fuel in response to the fuel indicator signal.

16. The apparatus of claim 15 wherein the pilot flame establishing means further comprises:
ignition means for igniting the pilot flame in the heating system; and
delay means for delaying for a stabilization period to allow the pilot flame to stabilize.

17. The apparatus of claim 15 wherein the inhibiting means further comprises:
closing means for closing a first fuel valve in a first fuel line supplying the heating system with the first fuel to block the flow of the first fuel in the first fuel valve; and
valve monitoring means for monitoring the first fuel valve for a closure time period to ensure that the first fuel valve is closed.

18. The apparatus of claim 15 wherein the first fuel comprises oil.

19. The apparatus of claim 18 wherein the extinguishing means further comprises:
purging means for purging an oil burner for a purge time period.

20. The apparatus of claim 19 wherein the purging means further comprises:
energizing means for energizing an oil purge output to rid the oil burner of any remaining oil.

21. The apparatus of claim 15 wherein the indication time period expires before the extinguishing means extinguishes the main flame.

22. The apparatus of claim 21 wherein the first fuel comprises gas.

23. The apparatus of claim 22 wherein the extinguishing means further comprises:
delay means for delaying an extinguishing time period to allow the main flame to burn any remaining gas.

24. The apparatus of claim 15 and further comprising:
atomizing air compressor means for providing atomizing air before the inhibiting means inhibits the flow of the first fuel.

25. The apparatus of claim 15 and further comprising:
safety shutdown means for issuing a safety shutdown of the heating system when the fuel changeover signal represents an invalid fuel series.

26. The apparatus of claim 25 wherein the safety shutdown means issues a safety shutdown of the heating system when the fuel indicator signal indicates that a plurality of fuels are the desired fuel.

27. The apparatus of claim 15 and further comprising:
post-purging means for post-purging the heating system when the fuel indicator signal is not received from the fuel selector within the indication time period; and
recycling means for recycling the heating system after post-purging.

28. The apparatus of claim 27 where the post-purging means post-purges the heating system and where the recycling means recycles the heating system when the fuel indicator signal changes to an unexpected, but valid value.

* * * * *

UNITED STATES PATENT AND TRADEMARK OFFICE

CERTIFICATE OF CORRECTION

PATENT NO. : 4,999,792

DATED : March 12, 1991

INVENTOR(S) : Gregory W. Anderson et al.

It is certified that error appears in the above-identified patent and that said Letters Patent is hereby corrected as shown below:

Col. 9, line 57, delete "sysstem", insert --system--.

Signed and Sealed this

Seventeenth Day of November, 1992

*Attest:*

DOUGLAS B. COMER

*Attesting Officer*

*Acting Commissioner of Patents and Trademarks*